US009017087B1

(12) United States Patent
Rossman

(10) Patent No.: US 9,017,087 B1
(45) Date of Patent: Apr. 28, 2015

(54) CABLE CONNECTOR ASSEMBLY AND CABLE TRAY HAVING A FLOATABLE CABLE CONNECTOR

(71) Applicant: Tyco Electronics Corporation, Berwyn, PA (US)

(72) Inventor: Jared Evan Rossman, Dover, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 20 days.

(21) Appl. No.: 14/057,077

(22) Filed: Oct. 18, 2013

(51) Int. Cl.
*H01R 13/64* (2006.01)
*H01R 13/73* (2006.01)
*H01R 9/03* (2006.01)

(52) U.S. Cl.
CPC . *H01R 13/73* (2013.01); *H01R 9/03* (2013.01)

(58) Field of Classification Search
USPC ..... 439/248, 247
See application file for complete search history.

(56) References Cited

U.S. PATENT DOCUMENTS

| | | | | |
|---|---|---|---|---|
| 4,909,748 | A * | 3/1990 | Kozono et al. | 439/247 |
| 6,325,652 | B1 * | 12/2001 | Grant | 439/248 |
| 8,465,312 | B2 * | 6/2013 | Di Stefano | 439/248 |
| 2006/0148293 | A1 * | 7/2006 | Herring et al. | 439/247 |
| 2006/0240696 | A1 * | 10/2006 | Ide et al. | 439/248 |
| 2012/0302081 | A1 * | 11/2012 | Daugherty et al. | 439/248 |
| 2014/0199868 | A1 * | 7/2014 | Okamoto et al. | 439/247 |

* cited by examiner

*Primary Examiner* — Gary Paumen

(57) ABSTRACT

A cable connector assembly including a cable connector having a mating side that faces in a mating direction. The mating side is configured to engage a mating connector. The cable connector assembly also includes a housing frame having a connector-receiving space that is partially defined by a sidewall. The cable connector is disposed in the connector-receiving space. The sidewall has a wall spring that is formed from material of the sidewall and that is coupled to the cable connector. The wall spring is configured to resiliently flex from a relaxed condition to a compressed condition to permit the cable connector to move during a mating operation. The wall spring provides a biasing force to the cable connector in the mating direction when the wall spring is in the compressed condition.

20 Claims, 10 Drawing Sheets

CABLE CONNECTOR ASSEMBLY AND CABLE TRAY HAVING A FLOATABLE CABLE CONNECTOR

BACKGROUND OF THE INVENTION

The subject matter herein relates generally to communication systems that utilize cable connectors.

Communication systems, such as network systems, servers, data centers, and the like, use large printed circuit boards, known as backplanes, to interconnect midplanes, daughter-cards, line cards and/or switch cards. The communication systems use high speed differential connectors mounted to the backplane and high speed differential connectors mounted to the line cards and switch cards to transmit signals therebetween. The backplane interconnects the various connectors using traces along the circuit board.

As the density of the systems increase and as the requirements for high speed lines become more complex, achieving a baseline level of signal integrity can be challenging. At least some systems have replaced the traditional backplanes with cabled backplane systems. In cabled backplane systems, cable connectors of a tray may directly engage mating connectors of the backplane system. A number of cable connectors may be mounted to a single tray, and a number of such trays may be inserted into and secured within a chassis of the backplane system. The trays may be positioned to engage, for example, daughter card assemblies that include the mating connectors.

However, managing a large number of cable connectors in such systems may be difficult. For example, the tray may include a sidewall having an elongated leading edge where the cable connectors are positioned. Due to the length of the leading edge, however, warping of the sidewall or manufacturing tolerances of the sidewall, cable connectors, and/or other components may cause the cable connectors to be incorrectly positioned in the tray. More specifically, the cable connectors may be positioned such that the cable connectors are unable to mate with the mating connectors or such that the cable connectors are more susceptible to inadvertent disengagement during operation of the cabled backplane system.

Solutions to the above problem may be difficult to achieve due to the configuration of the cabled backplane system. For instance, the large number of cables in such systems may be particularly problematic in high density cabled backplane systems in which space is limited and the trays need to be stacked directly adjacent to one another. Access to the components of the tray, such as the cable connectors or spacer bodies positioned between the cable connectors, may be difficult.

Apart from backplane systems, cable connector assemblies often use biasing mechanisms that permit the cable connector to float with respect to a housing of the cable connector assembly. These biasing mechanisms are typically separate assemblies that are enclosed within the housing or positioned alongside the housing. Moreover, these biasing mechanisms usually require multiple components that may be small and difficult to assemble.

A need remains for a cable connector assembly or a tray that may more reliably establish and maintain a communicative connection between a cable connector and a corresponding mating connector.

BRIEF DESCRIPTION OF THE INVENTION

In one embodiment, a cable connector assembly is provided that includes a cable connector having a mating side that faces in a mating direction. The mating side is configured to engage a mating connector. The cable connector assembly also includes a housing frame having a connector-receiving space that is partially defined by a sidewall. The cable connector is disposed in the connector-receiving space. The sidewall has a wall spring that is formed from material of the sidewall and that is coupled to the cable connector. The wall spring is configured to resiliently flex from a relaxed condition to a compressed condition to permit the cable connector to move during a mating operation. The wall spring provides a biasing force to the cable connector in the mating direction when the wall spring is in the compressed condition.

In another embodiment, a cable tray for a cabled backplane system is provided that includes a housing frame having first and second sidewalls with a connector-receiving space therebetween. The first sidewall includes first wall springs formed from material of the first sidewall, and the second sidewall includes second wall springs formed from material of the second sidewall. The cable tray also includes an array of cable connectors disposed within the connector-receiving space. The cable connectors have respective mating sides that face in a common mating direction and are configured to engage respective mating connectors. Each of the cable connectors of the array is coupled to at least one of the first wall springs and at least one of the second wall springs. Each of the first and second wall springs is configured to resiliently flex from a relaxed condition to a compressed condition to permit the corresponding cable connector to float during a mating operation. The first and second wall springs provide biasing forces to the corresponding cable connectors in the mating direction when the first and second wall springs are in the compressed conditions.

DETAILED DESCRIPTION OF THE INVENTION

Embodiments set forth herein include cable connector assemblies, cable trays, and cabled backplane systems including the same. Embodiments may include a moveable or floatable cable connector (or an array of such connectors) that is configured to engage a mating connector during a mating or loading operation. The communication system may be, for example, a cabled backplane system. However, it is understood that the embodiments set forth herein are not limited to cabled backplane applications.

The cable connector assemblies and cable trays may include one or more cable connectors and a housing frame that holds the cable connector(s). Each of the cable connectors may be coupled to a wall spring of the housing frame that permits the cable connector to move relative to the housing frame. For at least some embodiments that include multiple cable connectors, each of the cable connectors may be coupled directly or indirectly to at least one wall spring such that the cable connectors are permitted to move independently of each other. As such, one cable connector may be permitted to move more than other cable connectors. The wall springs may provide a biasing force when the cable connectors are engaged to a mating connector and the wall springs are compressed. Such embodiments may reduce the likelihood of the cable connectors being incorrectly positioned and, thus, may allow more tolerance in the manufacturing of the cable connector assemblies and communication systems that include the same.

The housing frame may have one or more sidewalls that define a connector-receiving space where the cable connectors are disposed. In particular embodiments, the wall springs may be formed from or with the material that forms the sidewall. By way of example only, during manufacture of the cable connector assembly, the sidewall may be stamped from a sheet of metal. The profile of the stamped sheet may include the wall spring and a remainder of the sidewall that defines the connector-receiving space. More specifically, the wall spring may be defined by one or more channels that are stamped entirely through the sidewall. As another example, the sidewall may be formed during a molding process, such as an injection molding process, in which a molten material (e.g., polymer, metal, polymer with metallic particles, and the like) is inserted into a cavity of a mold and permitted to cure or set within the mold. The cavity of the mold may be shaped such that the wall spring is formed with the remainder of the sidewall that becomes part of the housing frame. Embodiments having such built-in wall springs may, among other things, reduce the size and cost of the overall cable connector assembly compared to other cable connector assemblies that do not include the built-in wall springs.

Figure 1:
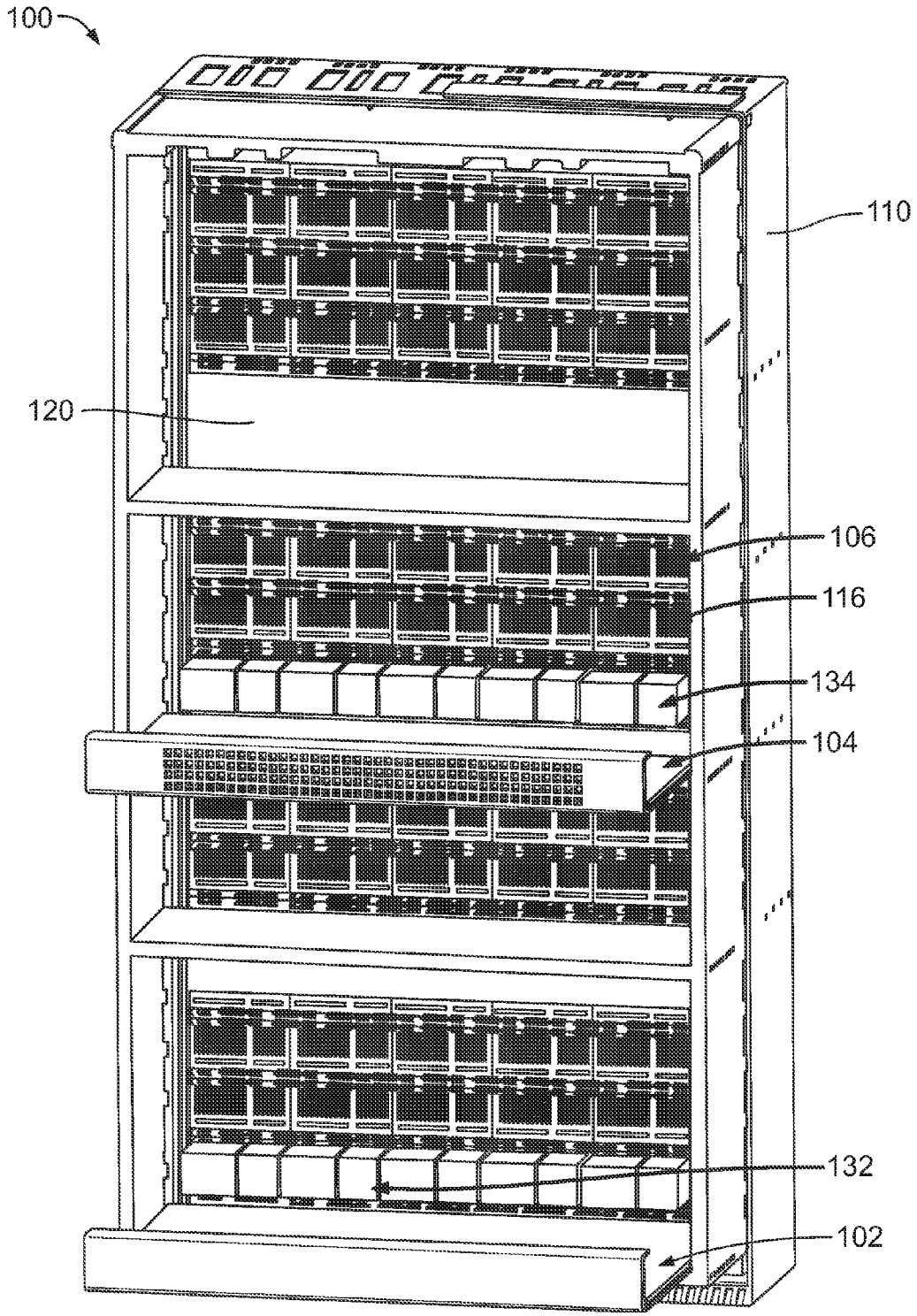
FIG. 1 is a front perspective view of a cabled backplane system formed in accordance with one embodiment.
Figure 2:
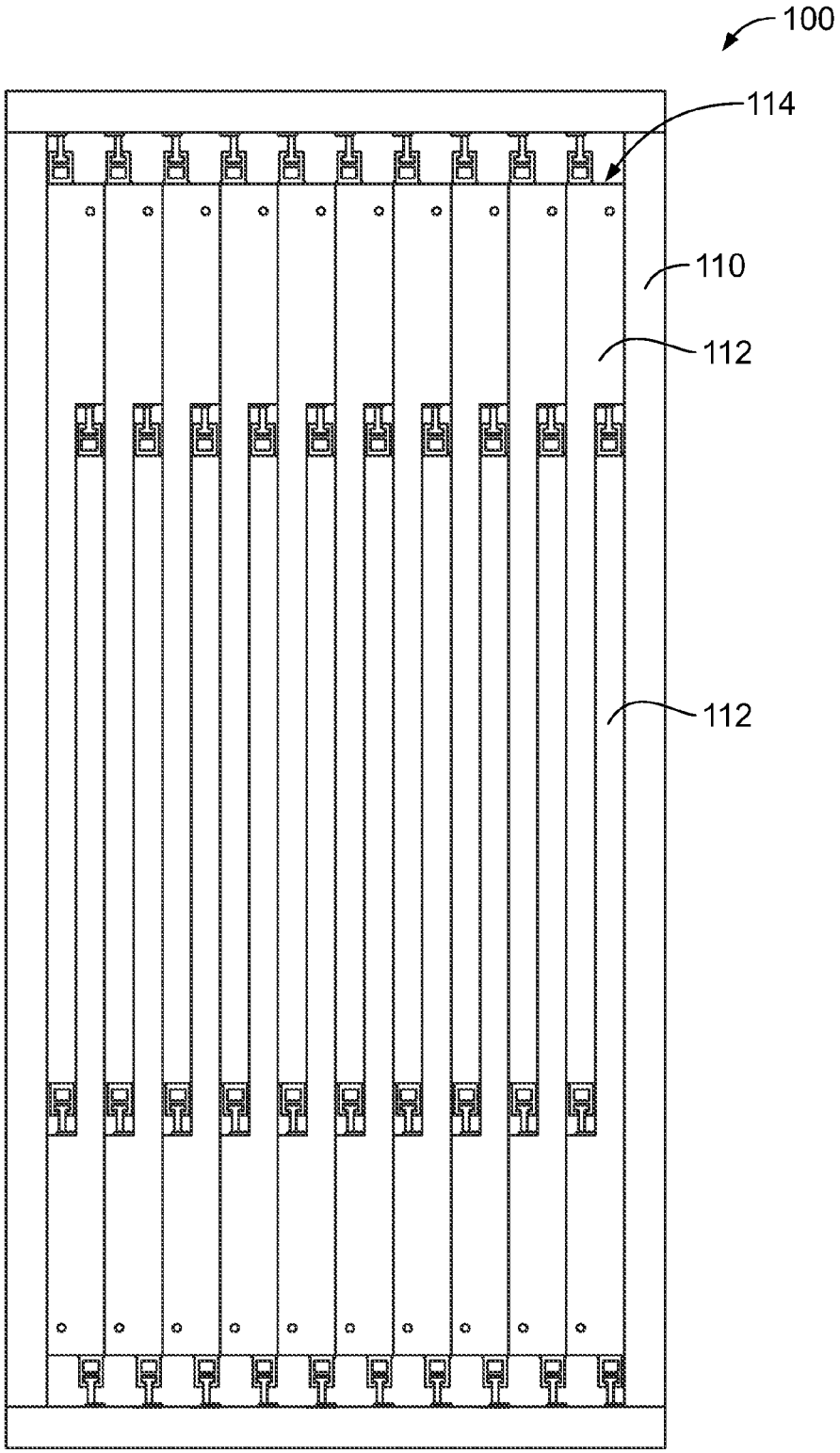
FIG. 2 is a rear perspective view of the cabled backplane system.

FIG. 1 is a front perspective view of a cabled backplane system 100 formed in accordance with an exemplary embodiment. The cabled backplane system 100 may be used in a data communication application, such as in a network switch. As shown in FIG. 1, the cabled backplane system 100 may interconnect daughter card assemblies, such as line cards 102 and switch cards 104 using interconnect assemblies 106. The line cards 102 may include mating connectors 132, and the switch cards 104 may include mating connectors 134. The mating connectors 132, 134 may also be referred to as receptacle connectors or daughter card connectors. It is noted, however, that the cabled backplane system 100 shown in FIGS. 1 and 2 is just one example of a cabled backplane system, and other configurations and types of backplane systems may be used with embodiments described herein. Embodiments may also be used in applications other than cabled backplane applications.

The interconnect assemblies 106 include cable connectors 116 that are interconnected by cable bundles 150 (shown in FIG. 4) within the cabled backplane system 100. The interconnect assemblies 106 may eliminate interconnections via traces of a circuit board, such as a backplane circuit board. The interconnect assemblies 106 may have improved signal performance along the signal paths between various connectors of the cabled backplane system 100 as compared to conventional backplanes. The interconnect assemblies 106 may support higher speeds (e.g., 10 Gb/s, 20 Gb/s, or more), longer signal path lengths, and lower cost per channel as compared to conventional backplane systems. The interconnect assemblies 106 may provide shielding of signal lines for improved signal performance. In one or more embodiments, the interconnect assemblies 106 are packaged in a structure that enables accurate positioning of the cable connectors 116 for mating with the corresponding line cards 102 and switch cards 104.

For example, the cabled backplane system 100 may include a chassis 110 that supports the components of the cabled backplane system 100. The chassis 110 may be, for example, a rack, a cabinet, or other suitable structure for holding the components of the cabled backplane system 100. The chassis 110 may include structures for guiding, supporting, and/or securing the line cards 102 and the switch cards 104 in the cabled backplane system 100.

The cabled backplane system 100 may include a backplane 120. The backplane 120 may be a circuit board and may be manufactured from typical circuit board material, such as FR-4 material. Electrical components, such as power supplies, fans, connectors, and the like may be attached to the backplane 120. Such electrical components may be electrically connected to traces or circuits of the backplane 120. The cable connectors 116 are not electrically connected to the backplane 120, as is typical of conventional backplanes, but rather the cable connectors 116 are interconnected by cables extending between the cable connectors 116. The backplane 120 may be manufactured from other materials in alternative embodiments, such as another dielectric material or a metal material. For example, the backplane 120 may be a metal sheet, which may be used in embodiments when no electrical routing on the backplane 120 is required.

Figure 4:
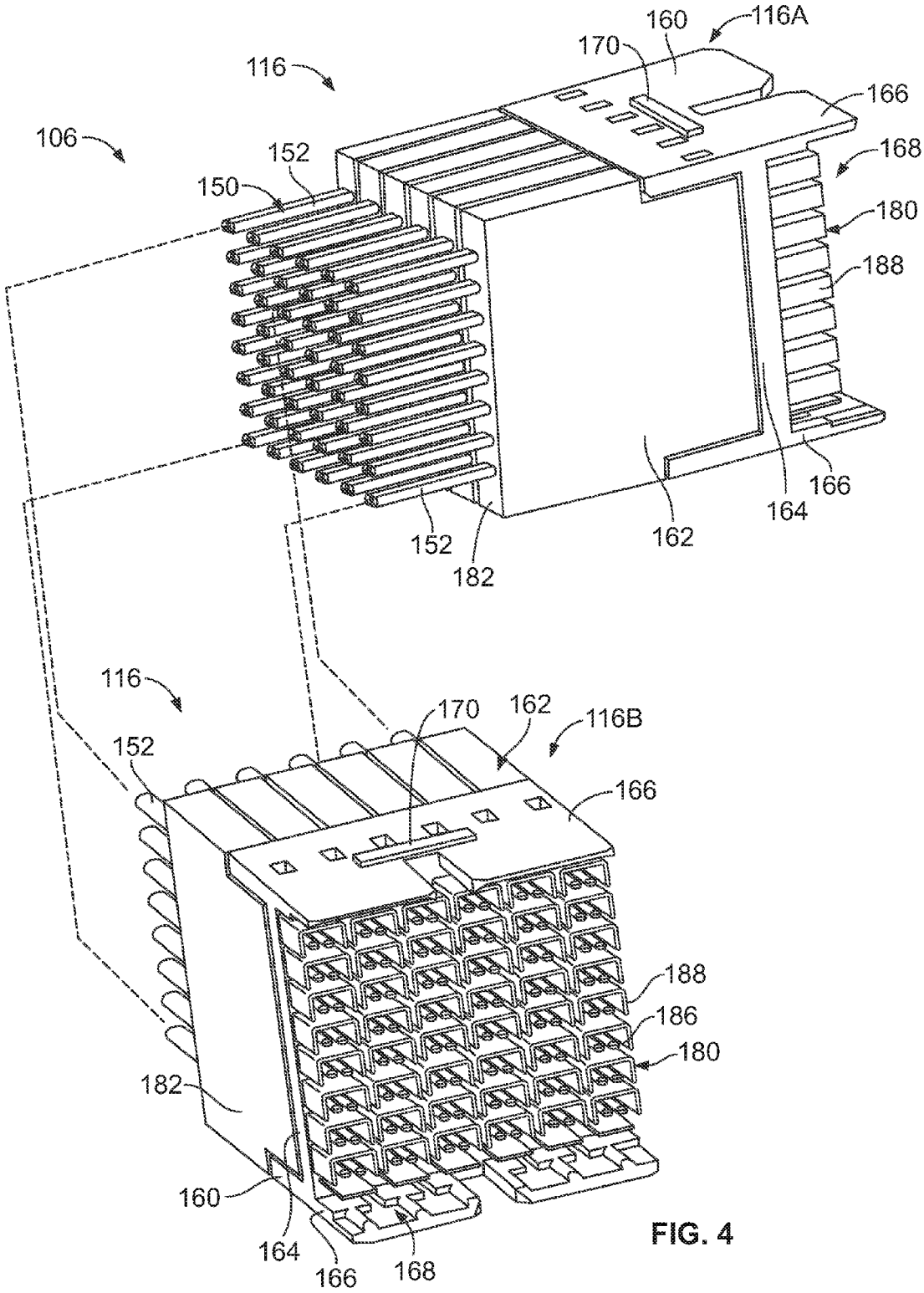
FIG. 4 illustrates interconnected cable connectors that may be used with the cabled backplane system of FIG. 1.

FIG. 2 is a rear perspective view of the cabled backplane system 100. As shown, the cabled backplane system 100 may include one or more cable trays 112. The cable trays 112 are configured to support and hold the interconnect assemblies 106 (FIG. 1) in designated positions. The cable trays 112 may be positioned within and stacked side-by-side in a system cavity 114 of the chassis 110. The cable trays 112 may be box-shaped and define connector-receiving spaces or raceways (not shown) for the cable bundles 150 (FIG. 4). The cable tray 112 may support a plurality of the cable connectors 116 which form parts of the interconnect assemblies 106. When the cable trays 112 are installed within the cabled backplane system 100, the cable trays 112 may be secured in fixed positions so that the cable trays 112 are not inadvertently dislodged. The cable trays 112 may be held in the fixed positions using frictional engagements and/or one or more locking mechanisms (not shown).

Figure 3:
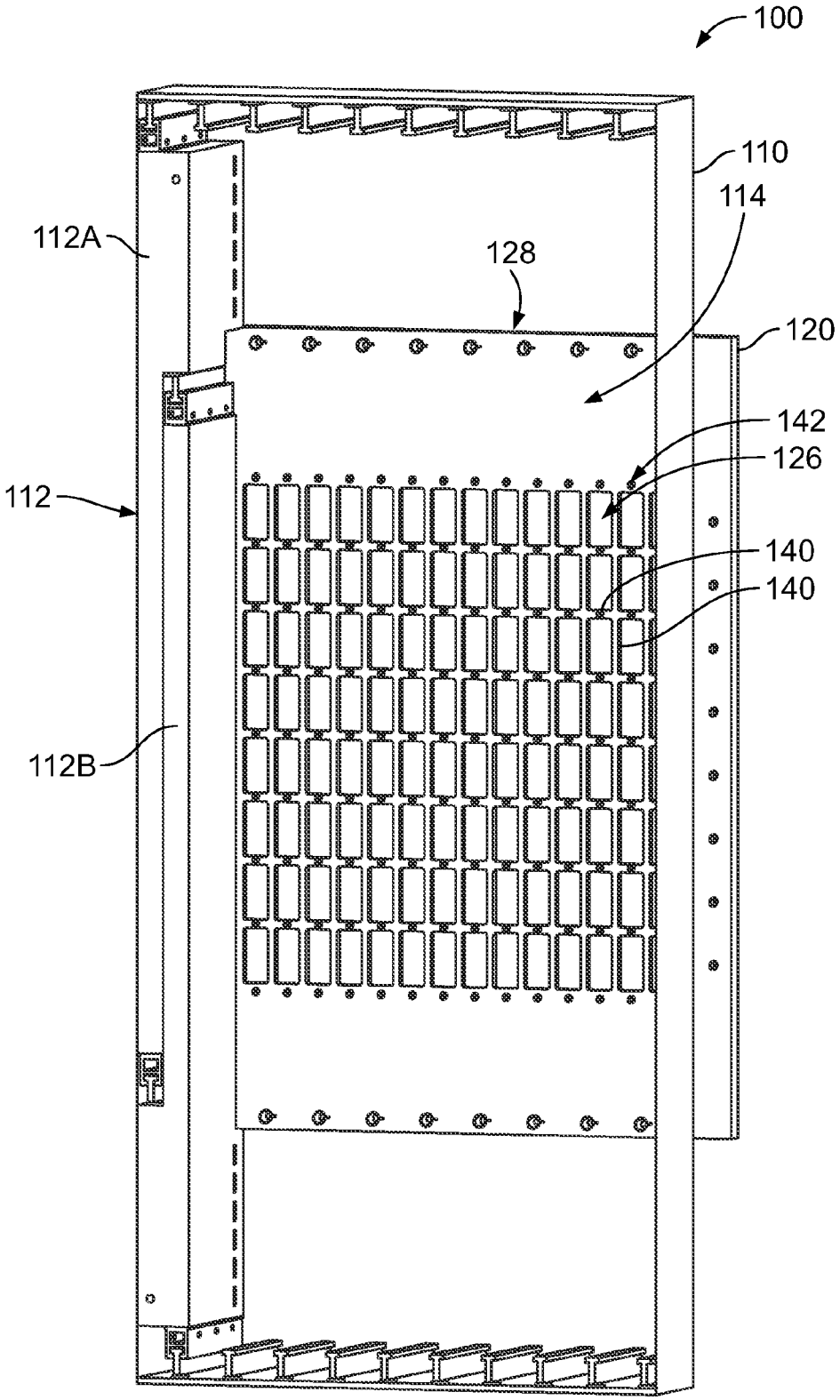
FIG. 3 illustrates a rear perspective view of the cabled backplane system with components removed for illustrative purposes.

FIG. 3 illustrates the cabled backplane system 100 with many of the cable trays 112 removed for clarity. Only two of the cable trays 112A, 112B are shown mounted to the chassis 110 and the backplane 120. As shown, the cable trays 112A, 112B may be positioned side-by-side and mounted within the system cavity 114 to engage the line and switch cards 102, 104 (FIG. 1). The cable trays 112A, 112B may have non-rectangular, but complementary shapes, such that when the cable trays 112A, 112B are positioned side-by-side, the cable trays 112A, 112B form a larger rectangular body.

The cable connectors 116 (FIG. 1) are configured to extend through openings 126 in the backplane 120. The cable connectors 116 may clear the backplane 120 such that the cable connectors 116 are exposed along a front 128 of the backplane 120 for mating with the line and switch cards 102, 104. In the illustrated embodiment, each opening 126 is sized and shaped to receive a single cable connector 116 therein. In alternative embodiments, however, the openings 126 may be sized to receive multiple cable connectors 116 therein.

In an exemplary embodiment, the cable connectors 116 are held in designated locations for mating with the line cards 102 and/or switch cards 104. The cable connectors 116 may be biased for engaging with mating connectors of the line and switch cards 102, 104 during a mating operation. The cable trays 112 may include features that align and position the cable connectors 116 with respect to the backplane 120. In an exemplary embodiment, because of the high density of the cable trays 112, an operator may have limited access to the cable connectors 116 or other components of the cable trays 112 once the cable trays 112 are installed in the cabled backplane system 100.

In some embodiments, the cable trays 112 may be configured to have some flexibility or capability of adjusting position within the system cavity 114 to allow the cable connectors 116 to align with and pass through the openings 126. The cable trays 112 may float relative to each other and with respect to the backplane 120 to properly align the cable connectors 116 with the corresponding openings 126. Once the cable trays 112 are coupled to the backplane 120, the backplane 120 may be used to hold the cable connectors 116 in precise locations for mating with the line and switch cards 102, 104. For example, the openings 126 may be used to control the final position of the cable connectors 116 for mating. In an exemplary embodiment, the cable connectors 116 float relative to one another to enable sufficient positioning of the cable connectors 116 with respect to the backplane 120 for mating with the mating connectors 132, 134 (both shown in FIG. 1) of the line and switch cards 102, 104, respectively.

As shown, the backplane 120 includes crossbars 140 between adjacent openings 126. The crossbars 140 may provide support for the backplane 120. The crossbars 140 may define or form mounting supports of the backplane 120 for securing the interconnect assemblies 106 and/or the cable tray 112 to the backplane 120. In some embodiments, the backplane 120 includes guide holes 142 through the crossbars 140 that are used for guidance or alignment of the interconnect assemblies 106 and/or the cable tray 112 during assembly. The guide holes 142 may receive guide features, fasteners, or other components used to assemble the cabled backplane system 100.

FIG. 4 illustrates an interconnect assembly 106 formed in accordance with an exemplary embodiment. The interconnect assembly 106 may include a plurality of the cable connectors 116, which may be referred to hereinafter as first and second cable connectors 116A, 116B, and a cable bundle 150 that extends between and communicatively couples the cable connectors 116A, 116B. The cable connectors 116A, 116B are provided at ends of the cable bundle 150. The cable bundle 150 includes a plurality of communication cables 152. During operation, the cable connector 116A may be connected to, for example, the mating connector 132 (shown in FIG. 1) of the corresponding line card 102 (shown in FIG. 1) and the cable connector 116B may be connected to the mating connector 134 (shown in FIG. 1) of the corresponding switch card 104 (shown in FIG. 1).

The cable connectors 116A, 116B may define header connectors. The cable connectors 116A, 116B are configured to be mated with the corresponding mating connectors 132, 134, which may be similar to STRADA Whisper receptacle connectors, commercially available through TE Connectivity, Harrisburg, Pa. In an exemplary embodiment, the cable connectors 116A, 116B are high speed differential pair cable connectors that include a plurality of differential pairs of conductors. The differential conductors are shielded along the signal paths thereof to reduce noise, crosstalk and other interference along the signal paths of the differential pairs.

In an exemplary embodiment, the cables 152 are twin axial cables having two signal wires within a common jacket of the cable 152. The signal wires convey differential signals. In an exemplary embodiment, the signal wires are shielded, such as with a cable braid of the cable 152. Optionally, each of the signal wires may be individually shielded. Other types of cables 152 may be provided in alternative embodiments. For example, coaxial cables may extend from the cable connector 116 each carrying a single signal conductor therein.

Each of the cable connectors 116A, 116B includes a header housing 160 holding a plurality of contact modules 162. The header housing 160 includes a base wall 164 and shroud walls 166 extending from the base wall 164 to define a mating cavity 168 configured to receive the corresponding mating connector. The shroud walls 166 may guide mating of the mating connector with the corresponding cable connector. In an exemplary embodiment, the header housing 160 has lugs 170 extending outward from the walls 166. The lugs 170 are used to locate the cable connector 116 with respect to the corresponding cable tray 112 (shown in FIG. 2).

Each of the contact modules 162 includes a plurality of cable assemblies 180 held by a support body 182. Each cable assembly 180 includes a pair of signal contacts 186 that may be terminated to signal wires of a corresponding cable 152. Each cable assembly 180 also includes a ground shield 188 providing shielding for the signal contacts 186. In an exemplary embodiment, the ground shield 188 peripherally surrounds the signal contacts 186 along a length of the signal contacts 186 to ensure that the signal paths are electrically shielded from interference.

The support body 182 provides support for the cable assemblies 180. The cables 152 extend into the support body 182 such that the support body 182 supports a portion of the cables 152. The support body 182 may provide strain relief for the cables 152. Optionally, the support body 182 may be manufactured from a plastic material. Alternatively, the support body 182 may be manufactured from a metal material. The support body 182 may be a metalized plastic material to provide additional shielding for the cables 152 and the cable assemblies 180. Optionally, the support body 182 may include a metal plate electrically connected to each ground shield to electrically common each ground shield 188 and a dielectric overmold overmolded around the cables 152 and portions of the metal plate to support the cables 152 and cable assemblies 180.

Multiple contact modules 162 may be loaded into the header housing 160. The header housing 160 holds the contact modules 162 in parallel such that the cable assemblies 180 are aligned in parallel columns. Any number of contact modules 162 may be held by the header housing 160 depending on the particular application. When the contact modules 162 are stacked in the header housing 160, the cable assemblies 180 may also be aligned in rows.

Figure 5:
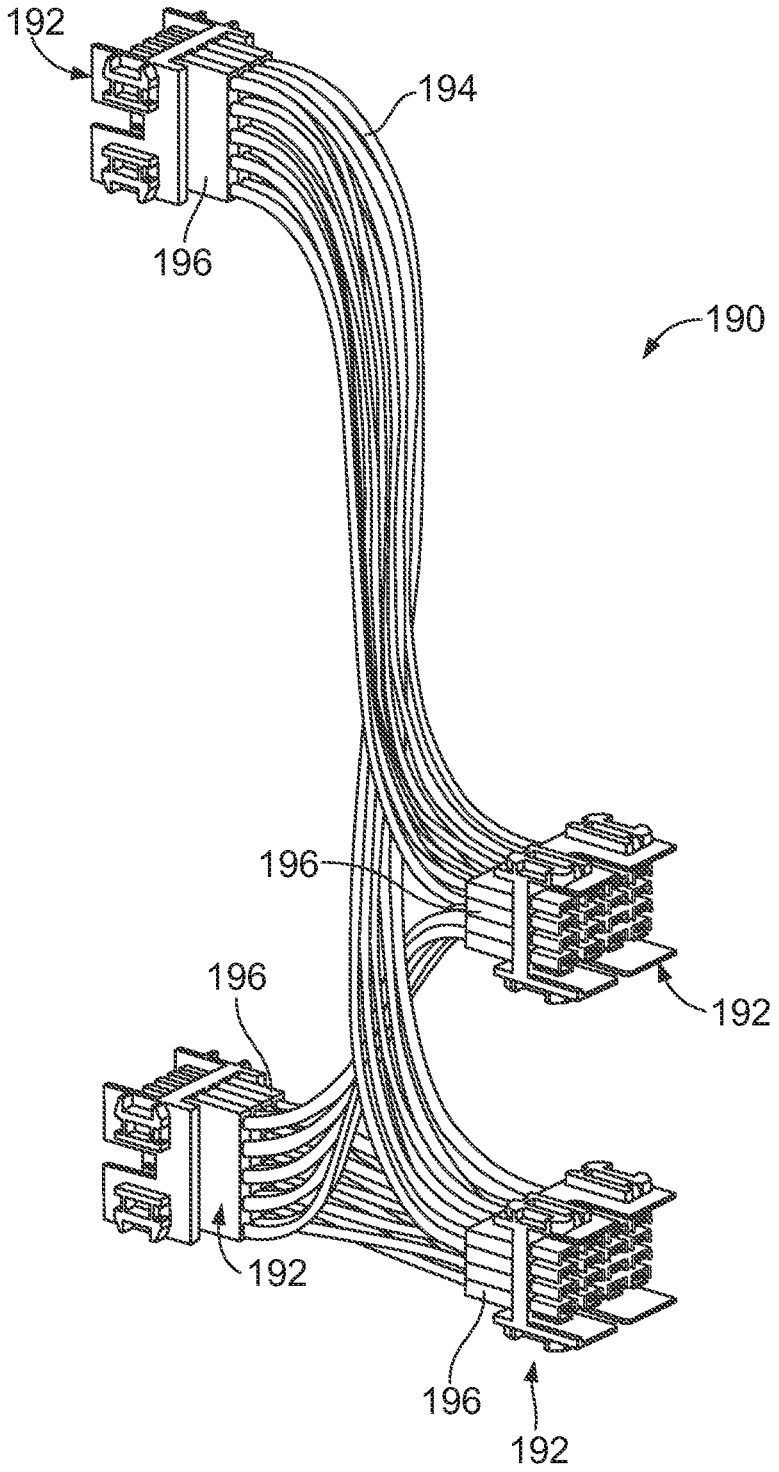
FIG. 5 illustrates interconnected cable connectors formed in accordance with another embodiment.

FIG. 5 illustrates an interconnect assembly 190 formed in accordance with an exemplary embodiment. The interconnect assembly 190 may be similar to the interconnect assembly 106 (shown in FIG. 4), but the interconnect assembly 190 includes more cable connectors 192. For example, four cable connectors 192 are shown in the embodiment of FIG. 5. Some of the cable connectors 192 may be used to interconnect with the mating connectors 132 (shown in FIG. 1), while other cable connectors 192 may be used to interconnect with the mating connectors 134 (shown in FIG. 1). The cable connectors 192 are interconnected by communication cables 194. Optionally, the cables 194 from a single cable connector 192 may be routed to several other cable connectors 192. For example, the cables 194 communicatively coupled to different contact modules 196 may be routed to different cable connectors 192.

Figure 6:
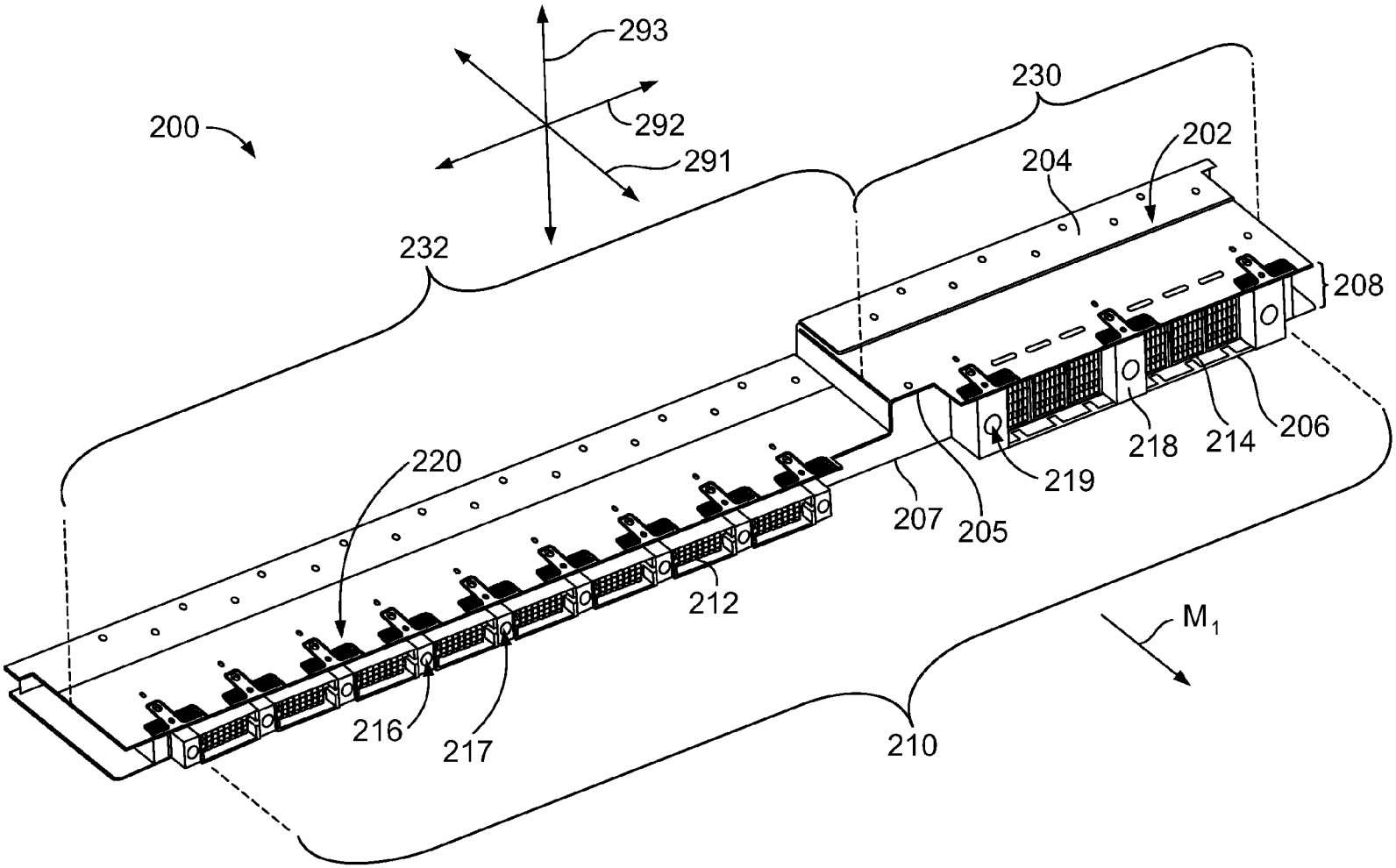
FIG. 6 is a perspective view of a cable tray formed in accordance with one embodiment that may be used with the cabled backplane system of FIG. 1.

FIG. 6 is a perspective view of a cable tray 200 formed in accordance with one embodiment. The cable tray 200 is oriented with respect to mutually perpendicular axes 291-293, including a mating or loading axis 291, a lateral axis 292, and an orientation axis 293. The cable tray 200 may be part of a cabled backplane system, such as the cabled backplane system 100. In other embodiments, however, the cable tray 200 may not be used in a backplane-type application. Accordingly, the cable tray 200 may be referred to more generally as a cable connector assembly, which may or may not be used in backplane-type applications.

The cable tray 200 may include similar features and components as the cable tray 112 (FIG. 2). The cable tray 200 may include a housing frame 202 that includes opposing first and second sidewalls 204, 206 having a connector-receiving space or cavity 208 therebetween. The connector-receiving space 208 may also be referred to as a raceway in some embodiments. Each of the sidewalls 204, 206 may partially define the connector-receiving space 208. The sidewalls 204, 206 have respective leading edges 205, 207. In some embodiments, the leading edges 205, 207 may be initially inserted into a system cavity (not shown) when the cable tray 200 is loaded into a cabled backplane system in a mating direction $M_1$. The mating direction $M_1$ may extend along the mating axis 291. The leading edges 205, 207 may interface with a backplane of the system, such as the backplane 120 (FIG. 3).

As shown, the cable tray 200 may include an array 210 of cable connectors 212, 214 that are disposed within the connector-receiving space 208. The array 210 may also be referred to as a connector array. In some embodiments, one or more of the cable connectors 212 is communicatively coupled to one or more of the cable connectors 214 through cable bundles (not shown), such as the cable bundle 150 (FIG. 4). The cable connectors 212, 214 may be positioned along the leading edges 205, 207 to engage mating connectors during a mating or loading operation. For example, in the illustrated embodiment, the cable connectors 212, 214 project beyond the leading edges 205, 207 in the mating direction $M_1$. However, the cable connectors 212, 214 are not required to clear the leading edges 205, 207 in order to be positioned along the leading edges 205, 207. For example, in other embodiments, the cable connectors 212, 214 may be positioned a depth within the connector-receiving space 208 from the leading edges 205, 207.

The cable connectors 212, 214 may be similar or identical to the cable connectors 116 (FIG. 1). For example, in the illustrated embodiment, the cable connectors 212, 214 are high speed differential connectors that are interconnected to one another through the cable bundles. However, other types of cable connectors may be used and the cable connectors are not required to be interconnected to one another in other embodiments.

The cable tray 200 is configured to hold the cable connectors 212, 214 in designated positions for engaging mating connectors (not shown) when the cable tray 200 is loaded into the cabled backplane system. To this end, the cable tray 200 may include spacer bodies 216, 218. The spacer bodies 216 are positioned between adjacent cable connectors 212, and the spacer bodies 218 are positioned between adjacent cable connectors 214. Optionally, the spacer bodies 216, 218 include respective guide cavities 217, 219. The guide cavities 217, 219 may be configured to receive a guide element, such as a guide post, during a mating operation. Alternatively, the guide cavities 217, 219 may be configured to hold a guide element that is received by another guide cavity (not shown) during the mating operation.

As shown in FIG. 6, the sidewall 204 may include wall springs 220 that are formed with the sidewall 204. The sidewall 206 may also include similar or identical wall springs 222 (shown in FIG. 10). The wall springs 220, 222 are configured to be coupled directly or indirectly to the cable connectors 212. The wall springs 220, 222 may permit the cable connectors 212 to be moved along the mating axis 291 during the mating operation. In the illustrated embodiment, the wall springs 220, 222 are directly coupled to the spacer bodies 216. In other embodiments, however, the wall springs 220, 222 may be directly coupled to the cable connectors 212.

The cable tray 200 includes a line card section 230 and a switch card section 232. The cable connectors 214 arranged in the line card section 230 are configured for mating with mating connectors, such as the mating connectors 132 (FIG. 1), that are associated with a line card, and the cable connectors 212 arranged in the switch card section 232 are configured for mating with mating connectors, such as the mating connectors 134, that are associated with a switch card. The cable tray 200 may have a different configuration of sections or only one section in alternative embodiments.

The housing frame 202 in the line card section 230 may be dimensioned differently than the housing frame 202 in the switch card section 232. For example, the housing frame 202 in the line card section 230 may have a greater height than the housing frame 202 in the switch card section 232, such as to accommodate different sized cable connectors. In the illustrated embodiment, the cable connectors 214 in the line card section 230 are larger than the cable connectors 212 in the switch card section 232. When the cable trays 200 are arranged in the cabled backplane system, a pair of the cable trays 200 may be positioned adjacent to each other and have complementary shapes such that the pair of cable trays 200 mate with each other. For example, one of the cable trays 200 may be inverted (e.g., rotated about the mating axis 291 by 180°) with respect to the orientation of the cable tray 200 shown in FIG. 6. The switch card sections 232 of the two cable trays 200 may be positioned side-by-side. The line card sections 230 of the two cable trays 200 may be at opposite ends of the assembly. Such an arrangement is similar to the arrangement of the cable trays 112A, 112B shown in FIG. 3 and may allow for tighter packing of the cable trays 200 in the cabled backplane system even though the line card section 230 and switch card section 232 have different dimensions.

Figure 8:
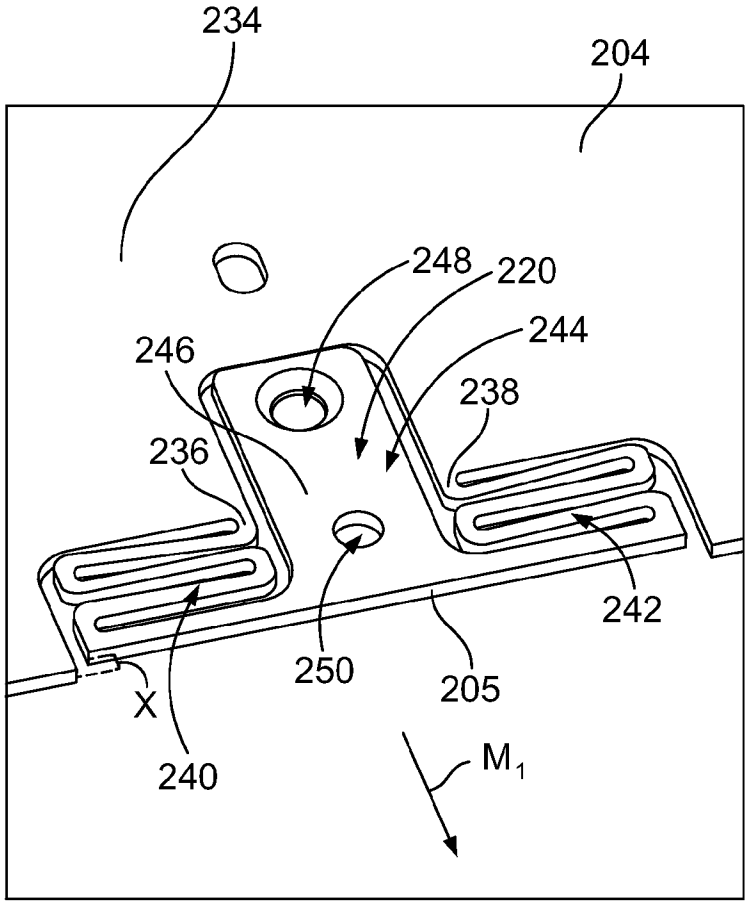
FIG. 8 illustrates the enlarged portion of the sidewall as shown in FIG. 7 illustrating the wall spring in a compressed condition.
Figure 7:
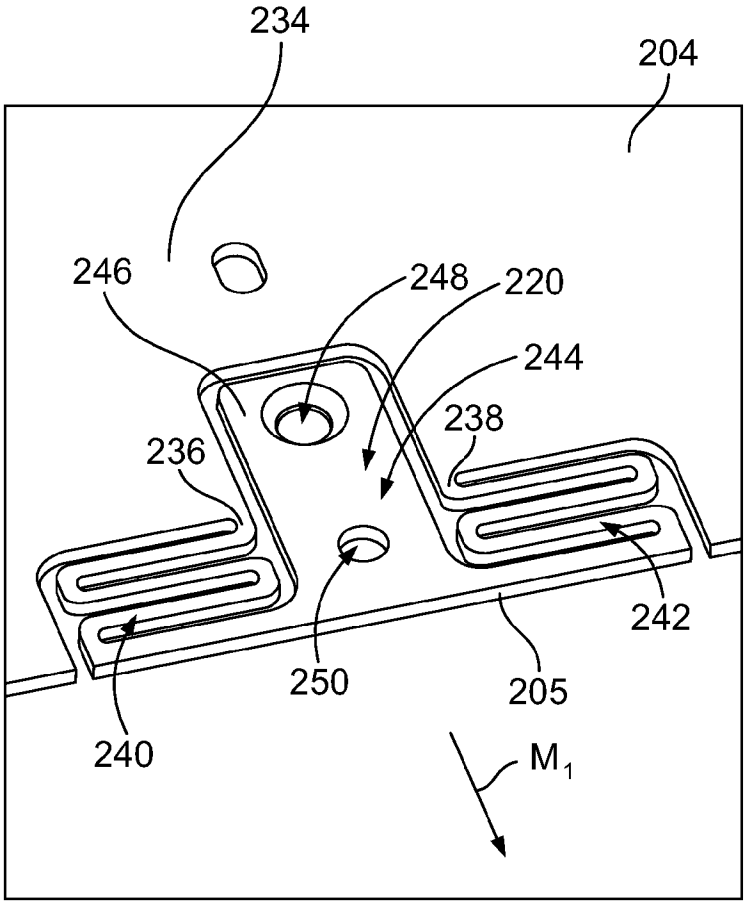
FIG. 7 illustrates an enlarged portion of a sidewall of the cable tray illustrating a wall spring in a relaxed condition.
Figure 10:
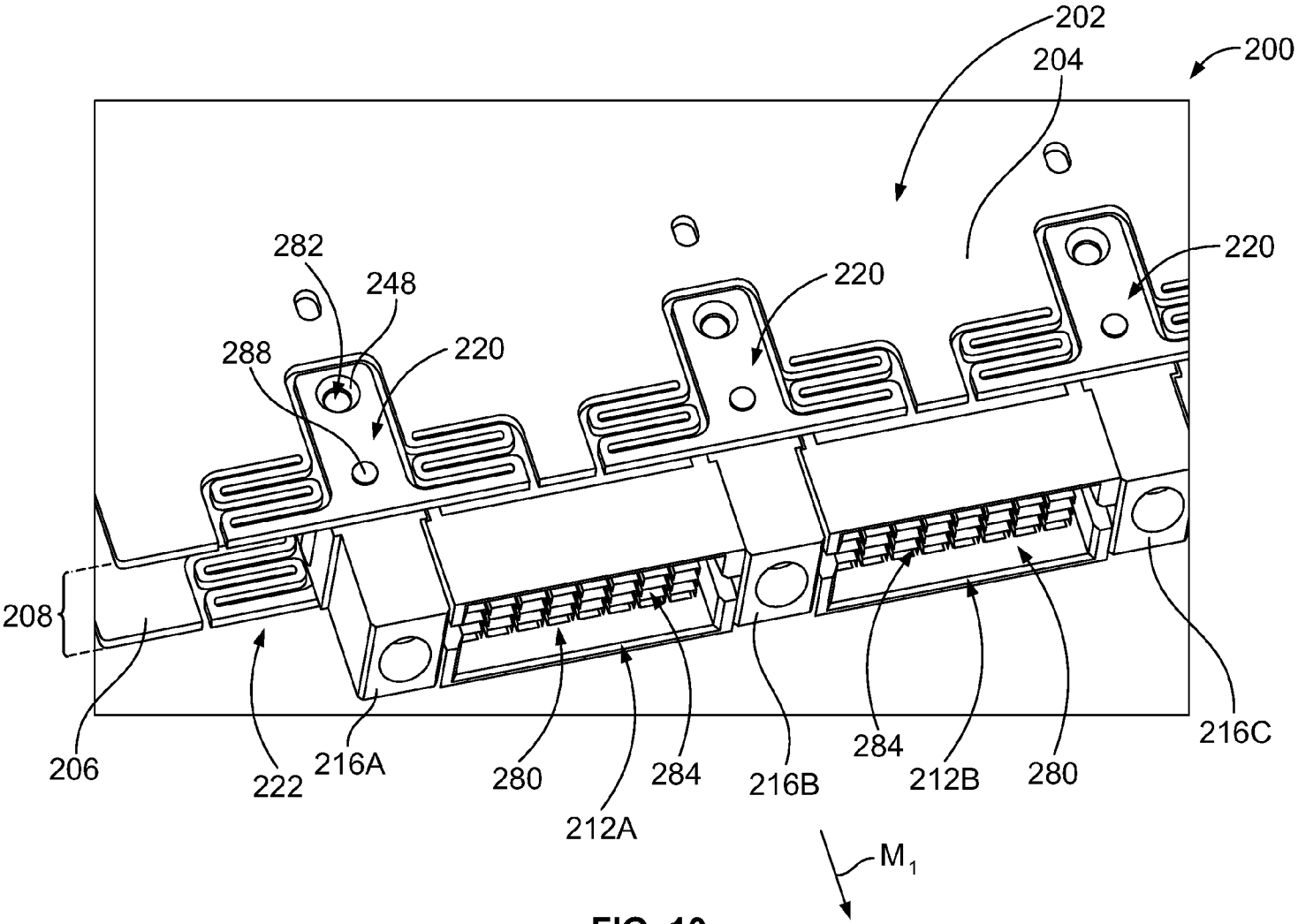
FIG. 10 is an enlarged perspective view of the cable tray of FIG. 6 illustrating wall springs coupled to spacer bodies that are coupled to cable connectors.

FIGS. 7 and 8 illustrate isolated portions of the sidewall 204 of the cable tray 200 (FIG. 6) when the wall spring 220 is in relaxed and compressed conditions, respectively. Although the following is with specific reference to the sidewall 204 and the wall spring 220, it is understood that the description may be similarly applied to the sidewall 206 (FIG. 6) and the wall spring 222 (FIG. 10). The wall spring 220 and the cable connector 212 (FIG. 6) may move relative to a wall support 234 during the mating operation. As shown, the wall spring 220 is formed from a common material of the sidewall 204. For instance, the sidewall 204 may include the wall spring 220, the wall support 234, and joints 236, 238 that join the wall support 234 to the wall spring 220. The wall spring 220, the wall support 234, and the joints 236, 238 may be part of a continuous portion of the sidewall 204 and may be formed during the same manufacturing process. For example, a common material may form each of the wall spring 220, the wall support 234, and the joints 236, 238 and the common material may be uninterrupted as the material extends along the wall spring 220, the wall support 234, and the joints 236, 238.

In particular embodiments, the sidewall 204 may be sheet metal that is stamped to form the wall spring 220. After the stamping operation, the sidewall 204 may include the wall spring 220 and a remainder of the sidewall 204, which includes the wall support 234 and the joints 236, 238. As such, the wall support 234, the joints 236, 238, and the wall spring 220 may be simultaneously formed through the stamping operation. More specifically, the wall support 234, the joints 236, 238, and the wall spring 220 may be part of a single continuous portion of the sidewall 204.

Prior to the stamping operation, the sidewall 204 may define a planar envelope or a thin sheet-shaped volume. More specifically, the planar envelope may represent the space occupied by the sheet metal that forms the sidewall 204. In some embodiments, after the stamping operation, the wall spring 220 may remain within the planar envelope. For example, the wall spring 220 may not be subsequently shaped such that the wall spring 220 extends out of the planar envelope. However, in other embodiments, the wall spring 220 may be shaped after being stamped from the sheet metal.

In such embodiments that utilize sheet metal, the sheet metals of the sidewalls 204, 206 may be sufficiently thin to permit the housing frame 202 (FIG. 6) to have some flexibility for moving, twisting, or otherwise manipulating the cable trays 200 into a designated position relative to the backplane in order to position the cable connectors 212 in openings (not shown) of the backplane. Optionally, the cable trays 200 may be connected to each other with some freedom of movement or float built into the connection to allow the cable trays 200 to move relative to one another to properly align the cable connectors 212 with openings of the backplane (not shown).

As another example, the sidewall 204 may be formed during a molding process, such as an injection molding process, in which a molten material (e.g., polymer, metal, polymer with metallic particles, and the like) is inserted into a cavity of a mold and permitted to cure or set within the mold. The cavity of the mold may include a portion that forms the wall support 234 and the joints 236, 238 and a portion that forms the wall spring 220. As such, the wall support 234, the joints 236, 238, and the wall spring 220 may be simultaneously formed through the same molding process. Again, the wall support 234, the joints 236, 238, and the wall spring 220 may be part of a continuous body of the material.

In the illustrated embodiment, the wall spring 220 has a pair of biasing arms 240, 242 and a coupling structure 244 that extends between the biasing arms 240, 242. The coupling structure 244 is configured to be secured to the spacer body 216 (FIG. 6) or, alternatively, directly to the cable connector 212. As such, the coupling structure 244 may move with the cable connector 212 when the wall spring 220 is flexed to the compressed condition. In the illustrated embodiment, the coupling structure 244 may include a part of the leading edge 205. As shown by comparing FIGS. 7 and 8, the leading edge 205 along the coupling structure 244 has a displaced position when the wall spring 220 is in the compressed condition shown in FIG. 8. More specifically, the leading edge 205 has been moved by a distance X in a direction that is opposite the mating direction $M_1$.

In the illustrated embodiment, the wall spring 220 has multiple biasing arms 240, 242. In other embodiments, however, the wall spring 220 may have only one biasing arm. The coupling structure 244 may also be optional. As such, in alternative embodiments, the wall spring 220 may include a single biasing arm without a coupling structure or a single biasing arm with a coupling structure. For embodiments that do not include a coupling structure, the biasing arm may be configured to directly engage the spacer body or the cable connector.

In the illustrated embodiment, the coupling structure 244 is configured to be directly coupled to the spacer body 216 (FIG. 6). For example, the coupling structure 244 may include an elongated panel body 246 having first and second securing holes 248, 250. The first securing hole 248 is sized and shaped to receive a fastener (e.g., screw) (not shown). The second securing hole 250 is sized and shaped to receive a post 288 (shown in FIG. 10) of the spacer body 216. In other embodiments, however, the coupling structure 244 may be directly coupled to the cable connector 212. For example, the fastener may be inserted through the first securing hole 248 and directly engage the cable connector 212 and the post 288 may be part of the cable connector 212.

Figure 9:
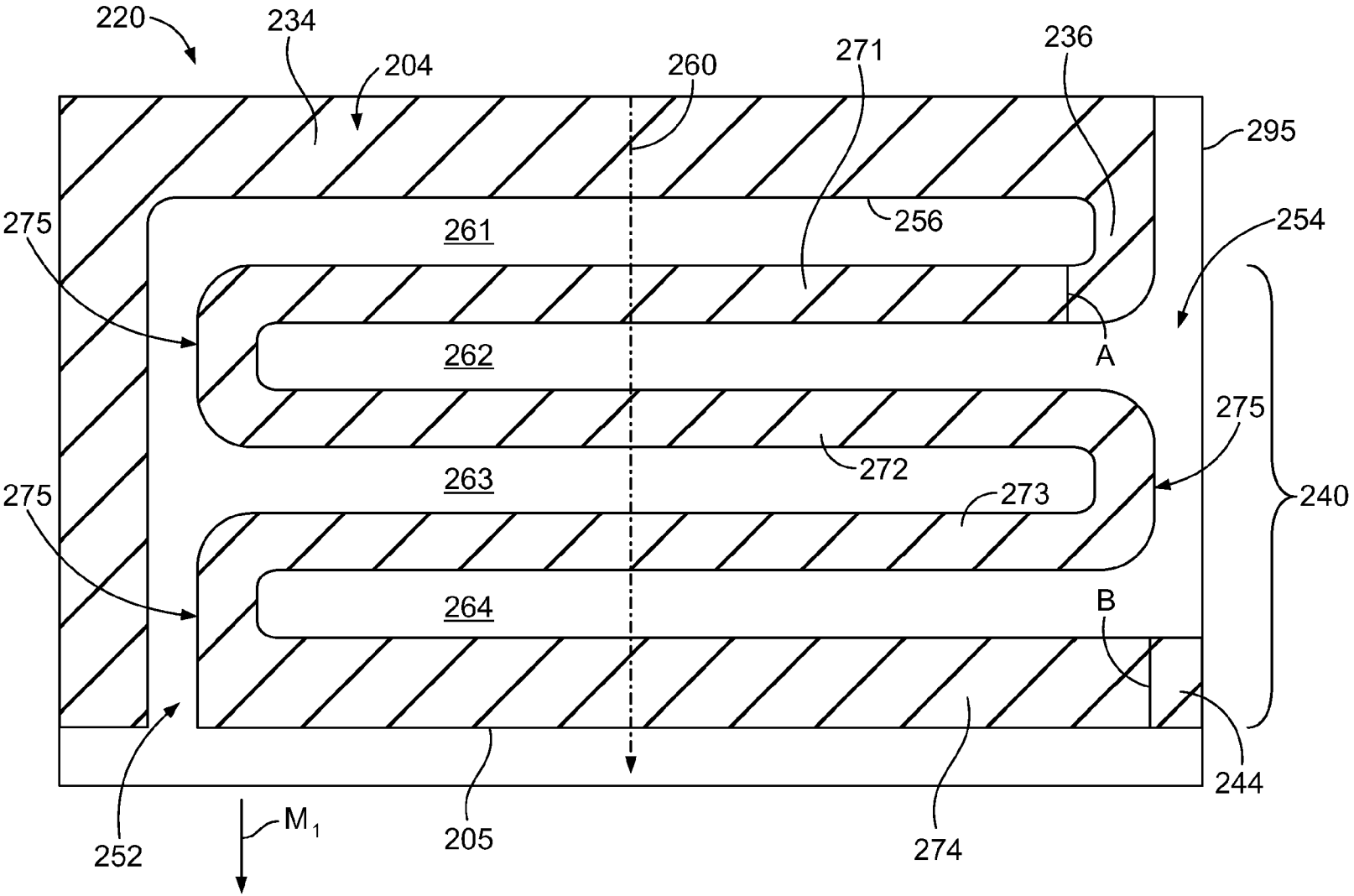
FIG. 9 is a cross section of a portion of the wall spring in the relaxed condition.

FIG. 9 is an enlarged cross-section of a portion of the wall spring 220 in the relaxed condition. More specifically, the cross-section is taken through the biasing arm 240 along a wall plane 295 that is parallel to the mating and lateral axes 291, 292 (FIG. 6). The wall plane 295 coincides with a portion of the sidewall 204 that includes the wall spring 220. Although the following is with specific reference to the biasing arm 240, the description may be similarly applied to the biasing arm 242.

As shown, the biasing arm 240 has an elongated non-linear shape that extends between points A and B. Point A is located adjacent to the joint 236 and point B is located adjacent to the coupling structure 244. The sidewall 204 includes an internal wall edge 256 that partially surrounds the biasing arm 240. As shown, the joint 236 may extend from a portion of the wall edge 256 that faces in the mating direction $M_1$. The wall edge 256 may be L-shaped in the illustrated embodiment and partially surround the biasing arm 240. The wall edge 256 may extend entirely within the wall plane 295.

In the illustrated embodiment, the biasing arm 240 has a serpentine or wave-like shape that permits the biasing arm 240 to be compressed toward the portion of the wall edge 256 that faces in the mating direction $M_1$ and enables the biasing arm 240 to flex away from the wall edge 256 in the mating direction $M_1$. As shown, the biasing arm 240 is oriented with respect to an arm axis 260 that extends parallel to the mating axis 291 (FIG. 6) and within the wall plane 295. The arm axis 260 extends in the mating direction $M_1$.

The biasing arm 240 may include lateral segments 271-274 that provide the biasing arm 240 with the serpentine or wave-like shape. More specifically, the lateral segments 271-274 extend substantially transverse to the arm axis 260 and substantially parallel to the lateral axis 292 (FIG. 6). Adjacent lateral segments 271-274 may be joined through bends or turns 275. In some embodiments, the bends 275 may be shaped so that a path taken by the biasing arm 240 substantially reverses direction at the bends 275. In such embodiments, adjacent lateral segments 271-274 may extend substantially parallel to each other. The bends 275 may be dimensioned to permit the biasing arm 240 to be compressed when an external force is applied in a direction that is opposite the mating direction $M_1$. In particular embodiments, as the biasing arm 240 extends from point A to point B, each subsequent lateral segment 271 is progressively closer to the leading edge 205.

The biasing arm 240 may be defined by one or more openings or channels extending through the sidewall 204. The channels may separate the wall spring 220 from the wall support 234. More specifically, one or more channels may define the biasing arm 240 and separate the biasing arm 240 from a remainder of the sidewall 204. For example, the sidewall 204 includes a channel 252 and a channel 254. The channel 252 opens at the leading edge 205 and the channel 254 is entirely surrounded by material of the sidewall 204. Each of the channels 252, 254 may have extensions that interleave with the extensions of the other channel to define the biasing arm 240. For example, in the illustrated embodiment, the channel 252 has extensions 261 and 263, and the channel 254 has extensions 262, 264. The extensions 261, 263 of the channel 252 and the extensions 262, 264 of the channel 254 alternate with one other to define the biasing arm 240.

The extensions 261-264 may separate adjacent lateral segments 271-274 from each other. More specifically, the extension 261 separates the lateral segment 271 from the wall edge 256; the extension 262 separates the lateral segments 271, 272 from each other; the extension 263 separates the lateral segments 272, 273 from each other; and the extension 264 separates the lateral segments 273, 274 from each other. In the relaxed condition, as shown in FIG. 9, the extensions 261-264 may have a maximum size. When the biasing arm 240 is flexed into the compressed condition, however, the extensions 261-264 may be reduced in sized or may be eliminated entirely such that the corresponding separated elements (e.g., adjacent lateral segments) contact each other.

The biasing arm 240 may comprise a material and be dimensioned to enable the biasing arm 240 to resiliently flex from the compressed condition to the relaxed condition. In particular embodiments, the biasing arm 240 may be configured to traverse the arm axis 260 at least two times. For example, in the illustrated embodiment, the biasing arm 240 traverses the arm axis 260 four times with the lateral segments 271-274. In other embodiments, the biasing arm 240 may traverse the arm axis 260 only three times or more than four times.

In particular embodiments, the biasing arm 240 may coincide with the wall plane 295 when the wall spring 220 is in each of the relaxed and compressed conditions. In such embodiments, the wall spring 220 may not require additional space unlike other known biasing mechanisms. However, the wall spring 220 is not required to coincide with the wall plane. For example, in other embodiments, the joint 236 between the wall spring 220 and the wall support 234 may be shaped such that the wall spring 220 extends out of the wall plane 295. In such embodiments, the biasing arm 240 may coincide with a loading plane that extends parallel to the wall plane 295.

FIG. 10 is an enlarged perspective view of the cable tray 200 showing two adjacent cable connectors 212A, 212B and three spacer bodies 216A-216C. In the illustrated embodiment, the cable connectors 212A, 212B are indirectly coupled to one another through the spacer body 216B such that movement of the spacer body 216B may cause each of the cable connectors 212A, 212B to move. However, in other embodiments, the adjacent cable connectors 212A, 212B may not be indirectly coupled through the spacer body 216B. Instead, the cable connectors 212A, 212B may be entirely separate from each other such that each is capable of moving independently without affecting the other.

In FIG. 10, the cable tray 200 includes the sidewalls 204, 206 of the housing frame 202 with the connector-receiving space 208 therebetween. As shown, each of the cable connectors 212A, 212B may be indirectly coupled to multiple wall springs. For example, the cable connector 212A is coupled to the spacer bodies 216A, 216B. The cable connector 212A may be coupled to the spacer bodies 216A, 216B by being directly secured (e.g., using a fastener or adhesive) or by forming a frictional engagement between the spacer bodies 216A, 216B. For example, the cable connector 212A may have exterior features that engage with complementary features of the spacer bodies 216A, 216B.

As shown, the spacer body 216A is directly coupled to one of the wall springs 220 of the sidewall 204 and one of the wall springs 222 of the sidewall 206. The spacer body 216A and the wall springs 220, 222 may be directly coupled through, for example, a fastener (not shown) that is inserted through the securing hole 248 and into a cavity 282 of the spacer body 216A. Likewise, the spacer body 216B may be directly coupled to one of the wall springs 220 of the sidewall 204 and one of the wall springs 222 of the sidewall 206. Accordingly, the cable connector 212A may be held in a designated position by two spacer bodies 216A, 216B that are each directly coupled to corresponding wall springs 220, 222. Also shown, the cable connector 212B may engage the spacer body 216B and the spacer body 216C. The spacer body 216C may also be directly coupled to one of the wall springs 220 of the sidewall 204 and one of the wall springs 222 of the sidewall 206.

The cable connectors 212A, 212B include respective mating sides 280 that face in the mating direction $M_1$. Each of the cable connectors 212A, 212B may have an array 284 of signal contacts that are exposed through the corresponding mating side 280. In some embodiments, the cable tray 200 may be installed and held in a fixed position within a cabled backplane system. When installed, the cable connectors 212A, 212B may be configured to have a forward-biased position such that each of the cable connectors 212A, 212B is positioned beyond where a final or mated position of the cable connector is configured to be. In other words, the cable connectors 212A, 212B are intended to be pushed in a direction that is opposite the mating direction $M_1$ by the mating connectors (not shown) during the mating operation. In such embodiments, the wall springs 220, 222 permit the cable connectors 212A, 212B to be displaced when the mating connectors engage the cable connectors 212A, 212B.

During the mating operation, the wall springs 220, 222 may resiliently flex from the corresponding relaxed conditions to the corresponding compressed conditions thereby permitting the cable connectors 212A, 212B to be displaced. Due to the tolerances of the cable tray 200 or the cabled backplane system (not shown), the cable connector 212A may be displaced more than the cable connector 212B or other cable connectors (not shown in FIG. 10) of the cable tray 200. As such, the wall springs 220, 222 may permit the corresponding cable connector to independently float with respect to other cable connector(s) during the mating operation. When the cable connectors 212A, 212B are displaced and the wall springs 220, 222 are held in the compressed conditions, a potential energy may exist within each of the wall springs 220, 222 that generates a biasing force in the mating direction $M_1$. The biasing force may facilitate maintaining a mated engagement between the corresponding cable connector and the corresponding mating connector.

Figure 11:
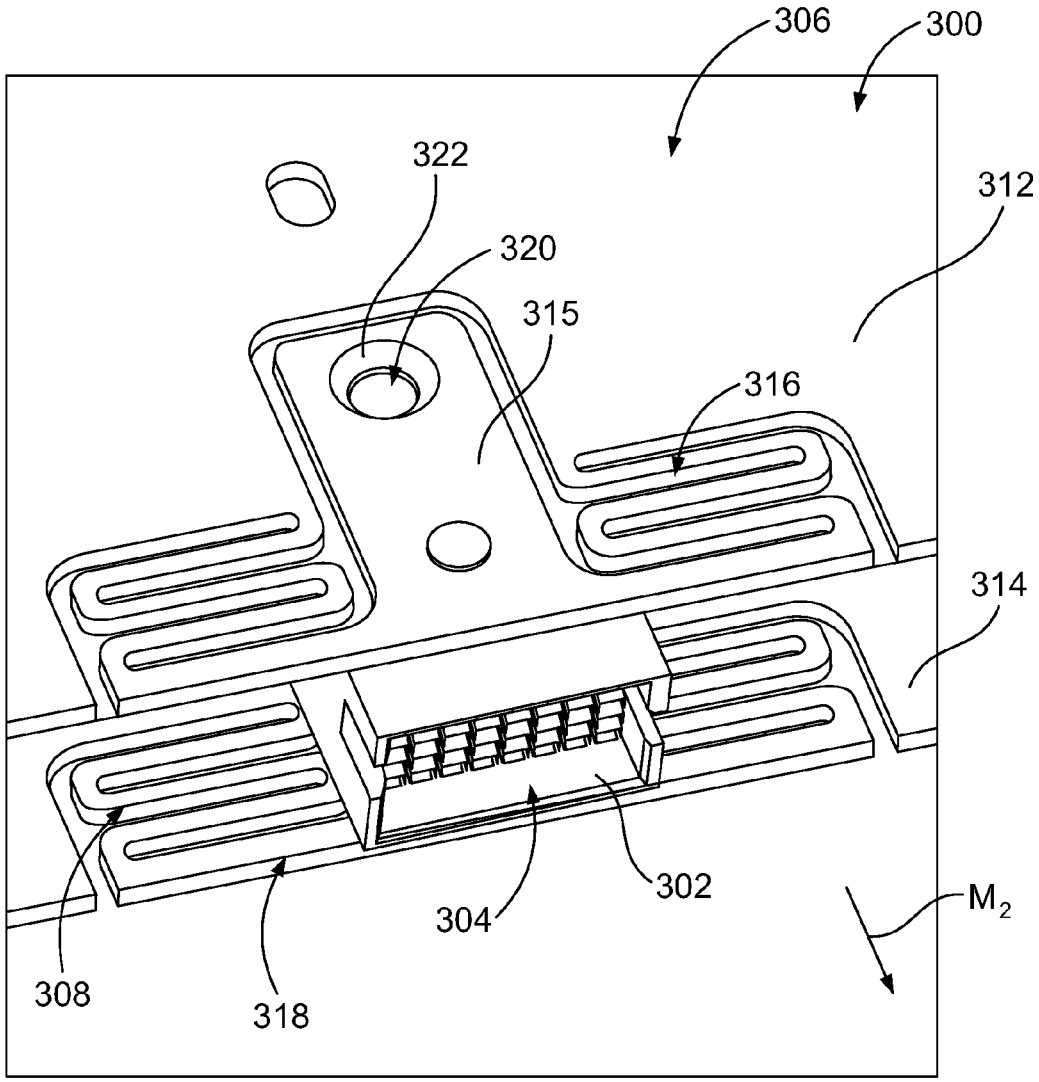
FIG. 11 is a perspective view of a cable connector assembly formed in accordance with an embodiment.

FIG. 11 is a perspective view of a cable connector assembly 300 formed in accordance with an embodiment. The cable connector assembly 300 includes a cable connector 302 having a mating side 304 that faces in a mating direction $M_2$. The mating side 304 may be configured to engage a mating connector (not shown). The cable connector assembly 300 may include a housing frame 306 that includes a connector-receiving space 308. The connector-receiving space 308 may be defined between first and second sidewalls 312, 314 of the housing frame 306. The cable connector 302 is disposed in the connector-receiving space 308 and held by the housing frame 306.

As shown, the sidewalls 312, 314 may include respective wall springs 316, 318. Similar to the wall springs 220, 222 (FIGS. 6 and 10) described herein, the wall springs 316, 318 may be formed from material of the sidewalls 312, 314, respectively. Unlike the other wall springs 220, 222, however, the wall springs 316, 318 may be directly coupled to the cable connector 302. For example, the cable connector 302 may have a cavity 320 that aligns with a securing hole 322 of a coupling structure 315 of the wall spring 316 and receives a fastener (e.g., screw). The wall springs 316, 318 may be configured to resiliently flex from a relaxed condition shown in FIG. 11 to a compressed condition similar to the compressed condition shown in FIG. 8. The wall springs 316, 318 may permit the cable connector 302 to move during a mating operation. Each of the wall springs 316, 318 may provide a biasing force to the cable connector 302 in the mating direction $M_2$ when the wall springs 316, 318 are in the corresponding compressed conditions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable connector assembly comprising:

a cable connector having a mating side that faces in a mating direction, the mating side configured to engage a mating connector; and a housing frame having a connector-receiving space that is partially defined by a sidewall, the cable connector being disposed in the connector-receiving space, the sidewall having a wall spring that is formed from material of the sidewall and that is coupled to the cable connector, the wall spring configured to resiliently flex from a relaxed condition to a compressed condition to permit the cable connector to move during a mating operation, the wall spring providing a biasing force to the cable connector in the mating direction when the wall spring is in the compressed condition.

2. The cable connector assembly of claim 1, wherein the sidewall includes a wall support that is coupled to the wall spring at a joint, the wall spring moving relative to the wall support when the wall spring flexes to the compressed condition, wherein the wall support, the wall spring, and the joint are part of a single continuous portion of the sidewall.

3. The cable connector assembly of claim 2, wherein the wall support, the wall spring, and the joint are either (a) stamped from a common piece of sheet metal or (b) formed in a common mold.

4. The cable connector assembly of claim 1, wherein the sidewall includes a wall support that is coupled to the wall spring at a joint, the wall spring being at least partially defined by a channel that separates the wall spring and the wall support.

5. The cable connector assembly of claim 1, wherein the sidewall is substantially planar and coincides with a wall plane, the wall spring including a biasing arm that has a serpentine shape, the biasing arm coinciding with the wall plane when the wall spring is in each of the relaxed and compressed conditions.

6. The cable connector assembly of claim 1, wherein the wall spring includes a biasing arm that is oriented with respect to an arm axis extending in the mating direction, the biasing arm having a serpentine shape that traverses the arm axis at least two times.

7. The cable connector assembly of claim 1, wherein the wall spring includes a biasing arm that has a serpentine shape that wraps back-and-forth within a loading plane, the biasing arm coinciding with the loading plane when the wall spring is in each of the relaxed and compressed conditions.

8. The cable connector assembly of claim 1, wherein the wall spring includes first and second biasing arms that are formed from the material of the sidewall and that are coupled to the cable connector.

9. The cable connector assembly of claim 1, further comprising a spacer body positioned adjacent to the cable connector in the connector-receiving space, the spacer body being coupled to the wall spring, the cable connector being coupled to the spacer body and indirectly coupled to the wall spring through the spacer body.

10. The cable connector assembly of claim 1, wherein the wall spring is formed to include a biasing arm and a coupling structure, the coupling structure being secured to and moving with the cable connector when the wall spring is compressed.

11. The cable connector assembly of claim 1, wherein the wall spring is directly coupled to the cable connector or a spacer body that is directly coupled to the cable connector.

12. The cable connector assembly of claim 1, wherein the cable connector has an array of signal contacts along the mating side and a cable bundle communicatively coupled to the signal contacts, the cable bundle permitting the cable connector to move when the wall spring flexes to the compressed condition.

13. A cable tray for a cabled backplane system comprising:

a housing frame including first and second sidewalls having a connector-receiving space therebetween, wherein the first sidewall includes first wall springs formed from material of the first sidewall and the second sidewall includes second wall springs formed from material of the second sidewall; and an array of cable connectors disposed within the connector-receiving space, the cable connectors having respective mating sides that face in a common mating direction and are configured to engage respective mating connectors;

wherein each of the cable connectors of the array is coupled to at least one of the first wall springs and at least one of the second wall springs, each of the first and second wall springs configured to resiliently flex from a relaxed condition to a compressed condition to permit the corresponding cable connector to float during a mating operation, the first and second wall springs providing biasing forces to the corresponding cable connectors in the mating direction when the first and second wall springs are in the compressed conditions.

14. The cable tray of claim 13, further comprising spacer bodies disposed alongside and coupled to corresponding cable connectors of the array, the first and second wall springs being coupled to the spacer bodies.

15. The cable tray of claim 13, wherein the first and second sidewalls include respective wall supports that are each coupled to the first and second wall springs, respectively, at corresponding joints, each of the first and second wall springs moving relative to the respective wall support when the corresponding wall spring flexes to the compressed condition.

16. The cable tray of claim 13, wherein the first and second wall springs have respective biasing arms that have a serpentine shape.

17. The cable tray of claim 13, wherein the first and second wall springs have respective biasing arms that are oriented with respect to arm axes extending in the mating direction, each of the biasing arms traversing the corresponding arm axis at least two times.

18. The cable tray of claim 13, wherein at least two or more of the cable connectors are communicatively coupled to each other through a communication cable disposed within the connector-receiving space.

19. The cable tray of claim 13, wherein the cable connectors are aligned along a loading plane.

20. The cable tray of claim 13, wherein each of the cable connectors has an array of signal contacts along the respective mating side and a cable bundle communicatively coupled to the signal contacts, the cable bundle permitting the corresponding cable connector to move when the first and second wall springs flex to the compressed conditions.

* * * * *